US007000590B2

(12) United States Patent
Carlton et al.

(10) Patent No.: US 7,000,590 B2
(45) Date of Patent: Feb. 21, 2006

(54) ENGINE OUTPUT CONTROL SYSTEM

(76) Inventors: Douglas J. Carlton, 3021 N. Sheridan Rd., Peoria, IL (US) 61604; Kevin B. Hagenauer, 105 N. Louise St., Chillicothe, IL (US) 61523; Christopher J. Wichael, 1628 W., County Oaks Ct., IL (US) 61525; David L. Zwetz, II, 27055 Lakeland Rd., Morton, IL (US) 61550

( * ) Notice: Subject to any disclaimer, the term of this patent is extended or adjusted under 35 U.S.C. 154(b) by 5 days.

(21) Appl. No.: 10/881,536

(22) Filed: Jun. 30, 2004

(65) Prior Publication Data

US 2006/0000442 A1 Jan. 5, 2006

(51) Int. Cl.
*F02D 41/14* (2006.01)

(52) U.S. Cl. ..... 123/357; 123/687; 701/104

(58) Field of Classification Search ..... 123/350, 123/357, 680, 687; 701/104
See application file for complete search history.

(56) References Cited

U.S. PATENT DOCUMENTS

| | | | | |
|---|---|---|---|---|
| 4,502,437 | A * | 3/1985 | Voss | 123/357 |
| 4,542,802 | A | 9/1985 | Garvey et al. | |
| 4,669,436 | A | 6/1987 | Nanjyo et al. | |
| 5,553,589 | A | 9/1996 | Middleton et al. | |
| 5,868,214 | A | 2/1999 | Workman | |
| 5,944,766 | A | 8/1999 | White | |
| 6,089,207 | A | 7/2000 | Goode et al. | |
| 6,196,188 | B1 * | 3/2001 | Janic et al. | 123/350 |
| 6,220,220 | B1 * | 4/2001 | Aketa et al. | 123/357 |
| 6,248,041 | B1 | 6/2001 | Den Besten | |
| 6,374,173 | B1 | 4/2002 | Ehlbeck | |
| 6,536,402 | B1 | 3/2003 | Houchin et al. | |
| 2004/0216454 | A1 * | 11/2004 | Giberson et al. | 60/330 |

* cited by examiner

*Primary Examiner*—Erick Solis

(57) ABSTRACT

A engine control system and a method of controlling a torque output of an internal combustion engine is disclosed. The engine control system comprises a torque receiving device operably connected to the engine, a sensor to sense an engine parameter, and an electronic device operably connected to the sensor. The electronic sensor is operable to determine a second engine speed from sensed engine parameters, a droop speed, and a selected one of a plurality of torque maps requiring a minimum amount of fuel. The electronic sensor is also operable to transmit a signal indicative of the second engine speed to a fuel system to control the amount of fuel delivered to the engine.

23 Claims, 3 Drawing Sheets

ENGINE OUTPUT CONTROL SYSTEM

TECHNICAL FIELD

The present disclosure relates to an engine control system and a method of controlling an internal combustion engine, and in particular to a programmable engine control system and method in which engine torque output can be controlled over a predetermined range of engine speeds.

BACKGROUND

Typical marine vessels generally have a first engine dedicated to propulsion of the vessel as well as a second engine to provide electrical power throughout the vessel. The second engine is also used to power other auxiliary devices such as pumps and electric generators. This is problematic such that two engines are required to provide separate functions, often having one engine run at a high percentage of its operation capacity to run one function while the other is being idled or used at a low percentage of its overall capacity performing another function. Furthermore, this type of operation can lead to premature wear or required service of one or both of the engines as the engines are not able to share the responsibility of the total load and operate more consistently and at less burdensome percentages of their overall capacities.

Additionally, marine vessels, when not traveling or operating on the open waters are docked and connected to shore power. In this situation, the vessels are typically dependent on the electricity from shore power connection and are not able to efficiently run the engines to reduce the amount of electricity required from the shore. This type of operation generally increases the vessel's operating costs.

In other marine vessel situations, two engines are setup in tandem to run a single propeller. Unfortunately, this type of operation, without the proper droop set up, does not allow for the engines to run equally and does not allow for the engines to be set up to run at predetermined percentages of each of the engine's total torque requirements. Rather, the engines would fluctuate.

It is often necessary in the marine industry to operate a propulsion engine in either a tandem application or a power generation application. Without droop, current electronic governors on propulsion engines operate in an isochronous mode and does not allow for stable operation in either power or tandem generation modes. An engine running isochronously is an engine always running at the same speed based on a given load. The idea of droop is not new to internal combustion engines. Droop allows the engine to run at different speeds for a given load. Current methods of droop generally calculate droop at a fixed speed. These methods do not account for multiple operating modes that a marine propulsion engine can operate in, such as smoke limiting, engine derate, or other programmable torque modes. By not accounting for the various operating modes, engine operation is not generally being performed to minimize fuel consumption and maximize engine life.

SUMMARY OF THE INVENTION

In one aspect of the present disclosure a method of controlling torque output from an engine having at least one torque receiving device is provided. The method comprises determining a first engine speed, selecting a one of a plurality of torque maps requiring a minimum amount of fuel for the first engine speed, determining a droop speed, combining the droop speed and the first engine speed, and obtaining a second engine speed.

In another aspect of the present disclosure an engine control system to control the torque output from an engine is provided. The engine control system has a torque receiving device operably connected to the engine, a sensor to sense an engine parameter, and an electronic device operably connected to the sensor. The electronic sensor is operable to determine a second engine speed from sensed engine parameters, a droop speed, and a selected one of a plurality of torque maps requiring a minimum amount of fuel. The electronic sensor is also operable to transmit a signal indicative of the second engine speed to a fuel system to control the amount of fuel delivered to the engine.

DETAILED DESCRIPTION

Figure 1:
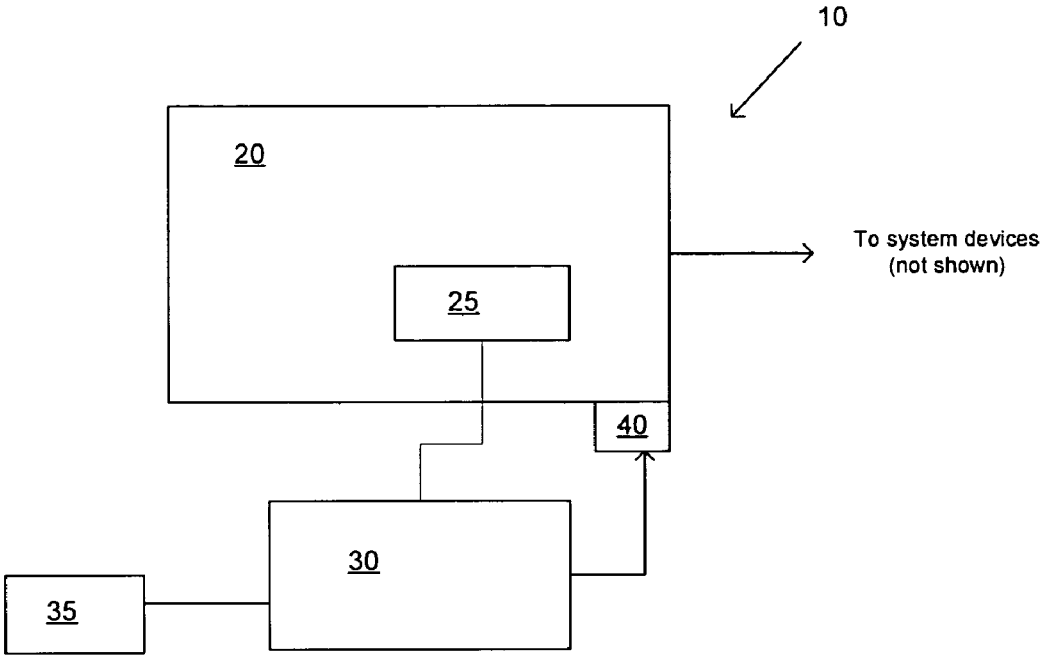
FIG. 1 diagrammatically illustrates an engine control system for controlling torque output of an engine according to one embodiment of the present disclosure.

While the system and method described herein are susceptible to various modifications and alternative forms, specific embodiments thereof have been shown solely by way of example in the drawings and are herein described in detail. It should be understood, however, that there is no intent to limit the invention to the particular form disclosed, but on the contrary, the intention is to cover all modifications, equivalents, and alternatives falling within the spirit and scope of the invention as defined by the appended claims.

With reference to FIG. 1, an engine control system 10 to control torque output from an engine 20 is shown. The engine control system 10 includes sensors 40 sensing various engine parameters. These engine parameters may comprise, but are not limited to an engine speed, torque, engine pressure and engine temperature. The engine parameters sensed by the sensors 40 may be communicated to an electronic device 30, the electronic device also receiving a first engine speed signal from an input device 35. Based on the first engine speed and engine parameters, the electronic device 30 determines a second engine speed and generates a signal that may be transmitted to a fuel system 25. The fuel system 25 may be operable to receive the signal generated by the electric device 30 and thereby control the amount of fuel delivered to the engine 20. The signal generated by the electronic device 30 is operable to adjust the first engine speed to a second engine speed and thereby modify the output of the engine 20 to a torque receiving device if the engine control system 10 is enabled.

Figure 2:
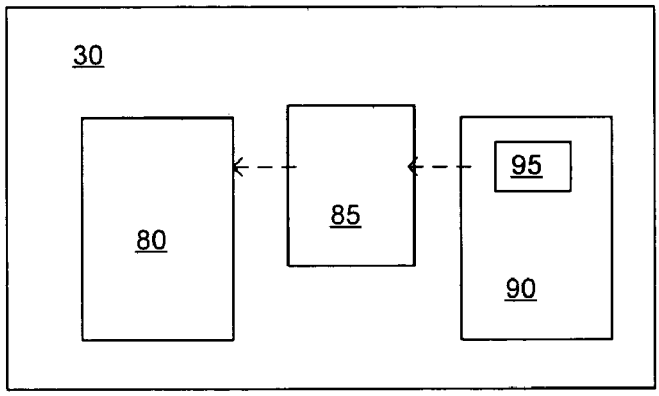
FIG. 2 diagrammatically illustrates an electronic device according to one embodiment of the present disclosure.

With reference to FIG. 2, an electronic device 30 is shown. The electronic device 30 contains a memory 80, on which a computer program 85 is stored. The computer program 85 stores instructions 90 which include torque-fuel maps 95. The electronic device 30 will query each one of a plurality of torque-fuel maps 95 and select the associated map 95 requiring the minimum amount of fuel related to the first engine speed. The torque fuel maps 95 may be determined from one of an unlimited number of factors including: water temperature, exhaust temperature, oil pressure, air inlet pressure, coolant temperature, etc. These torque-fuel maps 95 may include, but are not limited to torque limit maps, smoke maps, and various programmable torque maps, and may be used by the electronic device 30 to determine the second engine speed and an amount of fuel needed by the engine 20 to operate the torque receiving devices. The instructions 90 and torque-fuel maps 95 may be developed from engine empirical data and programmed into a language understandable by the electronic device 30.

The torque-fuel maps 95 may be based on temperatures of the engine, such as low, medium, and high (e.g., cold, warm, hot) temperatures. As an example, maps based on 30° C., 60° C., and 90° C. SCAC temperature may be used. Multiple temperature maps may be used because when some large engines operate at a low engine temperature, for example, at a start-up condition, more fuel may be required to maintain a constant torque for the engine, than when the engine is operating at a high temperature. Including a plurality of maps at engine operating set points such as the temperatures described above enables the electronic device 30 to regulate fuel accordingly. Alternatively, only a single temperature map may be used, while the other maps are disabled. Additionally, the torque-fuel maps 95 may be adjusted as well as enabled and disabled according to the aforementioned factors, such as engine temperature as well as selectively adjustable and manually controllable according to operator preference.

Further, the instructions 90 may also be capable of interpolating and extrapolating the torque-fuel maps 95 for engine temperatures falling between or outside of the torque-fuel maps 95 to determine a sufficient fuel quantity or fuel position, i.e., rack value at these temperatures. In addition, the instructions 90 may also include a feature wherein when a system sensor 40 indicates an out-of normal operating condition, e.g., if coolant temperature is not within a range of predetermined coolant temperatures, the electronic device 30 adjusts the torque-fuel maps 95 based on the instructions 90 for that engine 20.

Further, instructions 90 may also include a feature wherein when sensors 40 indicate that a predetermined engine or operating condition occurs, e.g., a droop is activated and control of engine torque is automatically initiated. Sensors 40 would, for example, measure rotation of a shaft, engine temperature or pressure, etc., for sensing this predetermined condition. This later feature of the electronic device 30 may reduce the amount of operator time required to operate the system.

Figure 3:
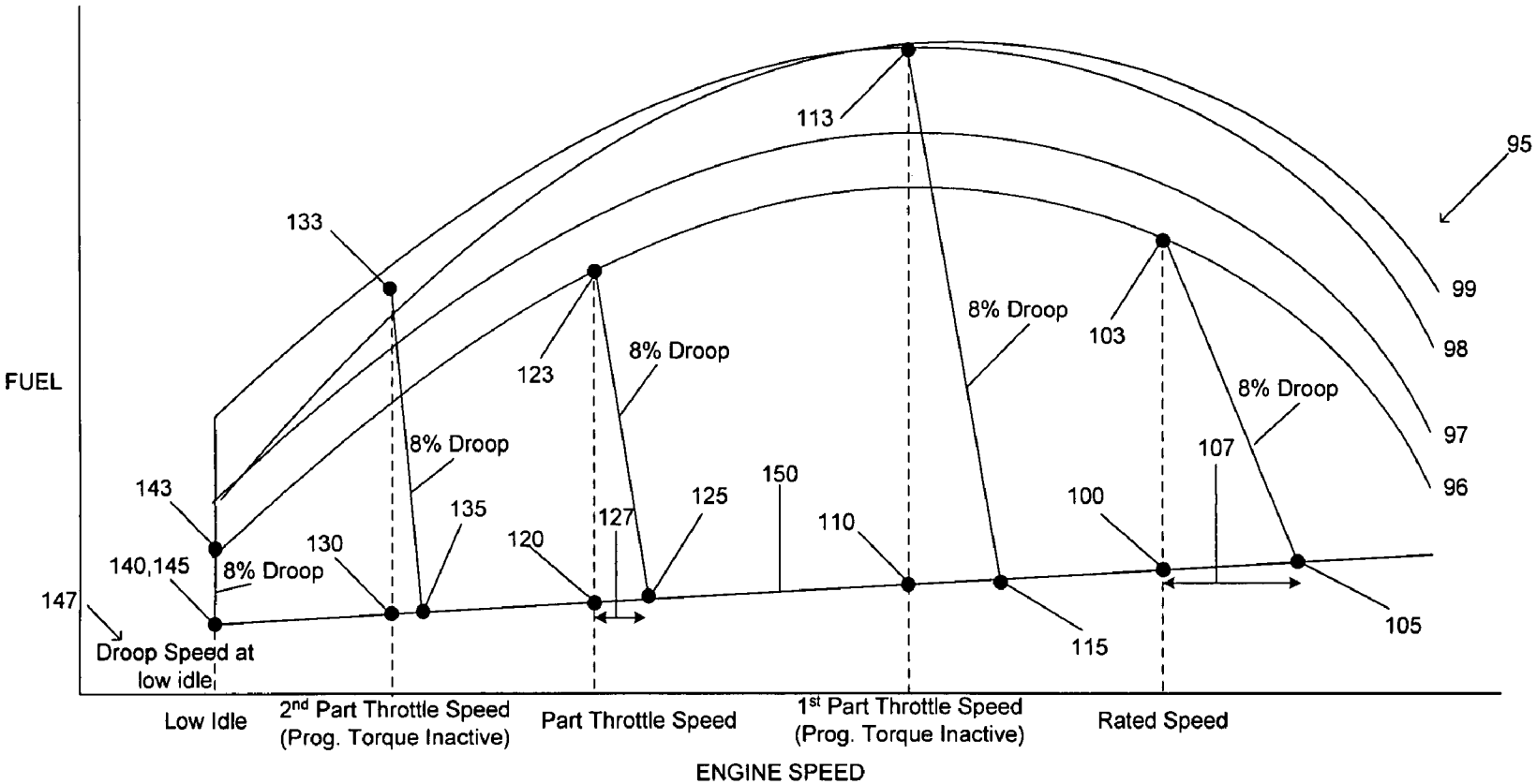
FIG. 3 is a graph diagrammatically illustrating the fuel and engine speed relationship according to various embodiments of the present disclosure.

FIG. 3 is a graph diagrammatically illustrating the fuel and engine speed relationship, and the aforementioned torque-fuel maps 95 that may be determined from any one of a number of the aforementioned ways. These torque-fuel maps 95 include a first programmable torque map 96, a second programmable torque map 97, a torque limit map 98, and a smoke map 99. The lines from the first engine speeds 100, 110, 120, 130, and 140 to the second engine speed 105, 115, 125, 135, and 145 all represent droop according to the present disclosure under various operating conditions and engine control system 10 configurations. The electronic device 30 is able to control the torque-fuel output from the engine by utilizing a selected one of a plurality of torque-fuel maps 95 requiring a minimum amount of fuel related to a first engine speed 100, 110, 120, 130, and 140. The first engine speed is usually selected from a range of engine speeds that will vary from engine to engine.

FIG. 3 also depicts a droop percentage of 8% and an enabled shrink factor. A droop percentage is generally a selectable percent of droop that is selected from a predetermined range of droop percentages. The droop percentage is used to determine the droop speed. Selecting a greater droop percentage will provide the engine 20 with a greater ability to respond to torque requirements of the system. A droop percentage of 0% will cause the engine to run in an isochronous mode. As mentioned in the background section, an isochronous mode is one in which the engine is always running at the same speed based on a given load. The selected droop percentage may generally be stored in memory 80. The shrink factor allows for a change in the droop speed as the first engine speed 100, 110, 120, 130, and 140 is determined. As the first engine speed 100, 110, 120, 130, and 140 increases, the droop speed will increase according to the selected droop percentage. As the first engine speed 100, 110, 120, 130, and 140 decreases and approaches a low idle speed, the droop speed will decrease such that the second engine speed 145 is isochronous at the low idle speed. As is evident in FIG. 3, the droop speed at the rated speed 107 is greater than the droop speed at part throttle 127, while the droop speed at low idle 147 is zero.

A method of controlling the torque output of an engine is disclosed. As shown in FIG. 3, the method determines a first engine speed 100 from the input device 35. With the droop and the shrink factor enabled, the electronic device 30 queries each of the torque-fuel maps 95 and selects the first programmable torque map 96 as it requires a minimum amount of fuel as compared to the other possible torque-fuel maps 95. A first engine speed at max fuel 103 is then determined. Based on the first programmable torque map 96, the first engine speed at max fuel 103, the selected droop percentage, and the shrink factor, a droop speed 107 is determined. The droop speed 107 is then combined with the first engine speed 100 to obtain the second engine speed 105 along the minimum fuel line 150. The second engine speed 105 will then be transmitted to the fuel system 25 to control the amount of fuel delivered to the engine 20. By leaving the first engine speed 100 at a fixed engine speed, then the engine speed will fluctuate to account for varying torque-fuel requirements. If torque-fuel requirement increases, then engine speed decreases in the direction from the second engine speed 105 to the first engine speed at max fuel 103. If the torque fuel requirement decreases, then engine speed increases in the direction from the first engine speed at max fuel 103 to the second engine speed 105. If a fixed percentage of the total torque-fuel output is desired, then the input device 35 may be modified to accommodate for the selected percentage of the torque-fuel output.

With reference to FIG. 3, after a first engine speed at a first part throttle speed 110 is determined from the input device 35, the electronic device 30 queries the torque-fuel maps 95. In this instance, the first programmable torque map 96 and the second programmable torque map 97 have been disabled. The electronic device 30 then selects the torque limit map 98 as it requires less fuel than the smoke map 99. A first engine speed at max fuel 113 is then determined. Based on the torque limit map 98, the first engine speed at max fuel 113, the selected droop percentage, and the shrink factor, a droop speed is determined. The droop speed is then combined with the first engine speed 110 to obtain the second engine speed 115 along the minimum fuel line 150. The second engine speed 115 may then be transmitted to the fuel system 25 to control the amount of fuel delivered to the engine. Similarly, for a first engine speed at a second part throttle speed 130, the programmable torque maps 96, 97 are disabled and the smoke map 99 is selected at that engine speed. Based on the smoke map 99, the first engine speed at max fuel 133, the selected droop percentage, and the shrink factor, a droop speed is determined and combined with the first engine speed 130 to obtain the second engine speed 135 along the minimum fuel line 150.

Figure 4:
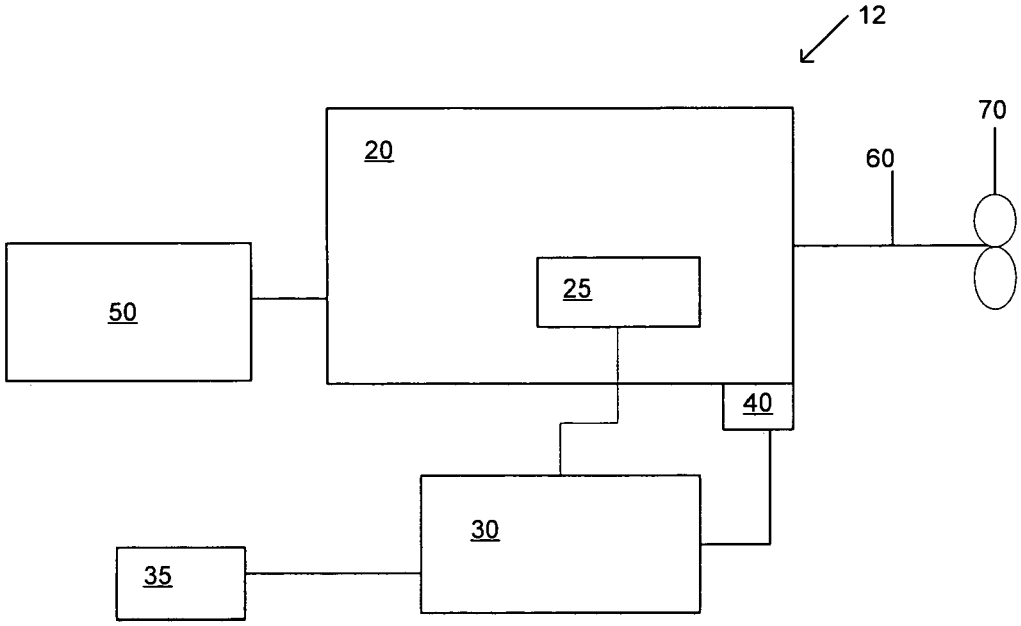
FIG. 4 diagrammatically illustrates an power generation system with an electronic control system to control a torque output of an engine according to one embodiment of the present disclosure.

With reference to FIG. 4, a power generation system 12 with an electronic control system 10 to control torque output of an engine 20 is provided. FIG. 4 is similar to FIG. 1, but includes a generator 50 connected to the engine 20 and an engine output shaft 60 connecting the engine 20 to a propeller 70. With droop enabled, a first engine speed is determined and the electronic device 30 is able to query the enabled torque-fuel maps 95 and select the map requiring a minimum amount of fuel. The selected torque-fuel map 95 will be used by the electronic device 30 to determine a second engine speed and to generate a signal representative of the second engine speed to be transmitted to the fuel system 25. The fuel system 25 may then adjust the delivery of fuel to the engine to modify the first engine speed to a second engine speed to accommodate the necessary torque-fuel output requirements of the propeller 70 and the generator 50. The generator 50 is then able to supply electrical power.

Figure 5:
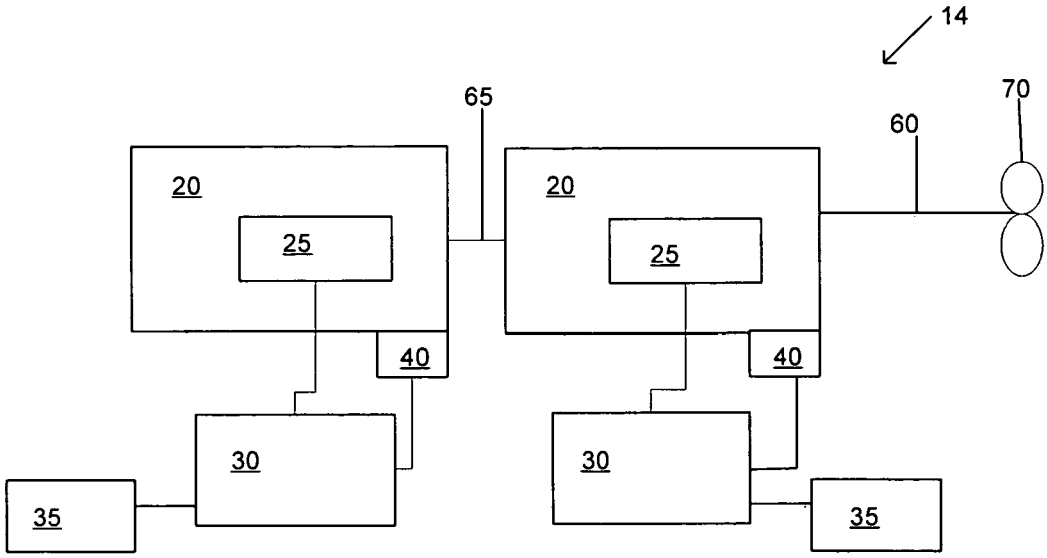
FIG. 5 diagrammatically illustrates a tandem engine system with an electronic control system to control torque output of an engine according to one embodiment of the present disclosure.

With reference to FIG. 5, a tandem engine system 14 with an electronic control system 10 to control torque output of an engine 20 is provided. FIG. 5 is also similar to FIG. 1, but includes two engines 20, two engine control systems 10, an engine connection shaft 65, and an engine output shaft 60 connecting the engines 20 to a propeller 70. With droop enabled, a first engine speed signal is determined by the input devices 35 and sent to the electronic devices 30. The electronic devices 30 are then able to query the enabled torque-fuel maps 95 and each electronic device 30 will select the associated torque-fuel map 95 requiring the minimum amount of fuel. The electronic devices 30 will use their selected torque-fuel maps 95 to determine a second engine speed and generate a signal representative of the second engine speed to be transmitted to the fuel systems 25 associated with each engine. The fuel system may then adjust the delivery of fuel to the engine to modify the first engine speed to a second engine speed. In this embodiment, each engine 20 may be setup to produce a predetermined percentage of the total torque-fuel output required by the torque receiving device.

The engine control system 10 may also contain a recorder (not shown) that records the system operating data that can be used, for example, to review operator practices, streamline troubleshooting, and speed up service. In addition, other embodiments may include a warning device (not shown) that warns the operator of any non-standard operating condition, and an operator override switch (not shown) that overrides the electronic device 30 may be included. The operator override switch may be integrated into the input device 35, although it need not be.

An optional display (not shown) may show engine parameters, such as engine speed, as well as system operating data, such as torque limits of the engine, pump fluid flow, pressure of fluids in the system, fuel quantity, temperature of system components, etc. The engine parameters may be displayed to an operator, in for example, the pilothouse of a boat by ways known to those skilled in the art.

A separate input device (not shown), such as a switch may be provided for setting a programmable droop on the engine. The input device may be some type of sensor that transmits an activation signal indicative of a predetermined condition being detected. This would in effect, automatically activate the programmable droop. Other embodiments may not use any input or activation device, thus keeping the programmable droop function constantly active. During system operation, e.g., co-generation, sensors 50 attached to the aforementioned system components monitor and collect the engine parameters, as well as the system operating data that may then be transmitted to the display and to an electronic device 30. The electronic device 30 controls the engine to operate at the programmable droop over a predetermined range of engine speeds, by controlling and regulating the amount of fuel needed by the engine 20 in order to maintain the programmable droop. Alternatively, the operator may disable the feature when in propulsion mode to return the engine to normal operation.

INDUSTRIAL APPLICABILITY

In practice, having programmable droop to control the torque output allows for a more stable overall operating condition of the engine 20. The electronic device 30 enables this by being able to calculate droop over an entire throttle range and by being able to query and selectively adjust the torque-fuel maps 95 in order to limit unnecessary fuel consumption. When activated, droop will select the minimum fuel requiring torque-fuel map 95 for a first engine speed and determine a second engine speed for the engine 20. The electronic device 30 will adjust the engine speed for the total torque required to operate the torque receiving devices, such as propellers 70, generators 50, and other auxiliary devices.

The addition of programmable droop enables the fuel system 25 to stabilize fuel delivery for load sharing between coupled engines or load sharing for power generation. The enhancements to the system protect against unfavorable operating conditions that could result in possible unstable engine operation. The electronic device 30 will droop the engine to stabilize the load or torque accordingly. Enabling the shrink factor may further enhance stabilized fuel delivery at lower engine speeds, especially low idle, by allowing the engine to operate in an isochronous mode.

In certain marine vessel setups, having programmable droop according to the present invention allows for a single engine 20 to enable propulsion of the vessel and provide electrical power to the vessel through a power generation setup 12. When the vessel is docked and connected to shore power, programmable droop allows for the engine 20 or engines 20 to efficiently operate to reduce the necessary amount of power supplied from shore to reduce operating costs. When two engines are setup in a tandem 14 to run a single propeller 70, programmable droop allows each engine 20 to be setup to run a predetermined percentage of the total torque output thereby extending the life of each of the engines 20.

What is claimed is:

1. A method of controlling the torque output from an internal combustion engine having at least one torque receiving device operable to receive torque from the engine, comprising:

determining a first engine speed;

selecting a one of a plurality of torque-fuel maps requiring a minimum amount of fuel related to the first engine speed;

determining a droop speed related to the first engine speed and the one of the plurality of torque maps;

combining the droop speed and the first engine speed; and obtaining a second engine speed from the droop speed and the first engine speed.

2. The method as set forth in claim 1, including:

generating a signal indicative of the second engine speed; and delivering the signal to a fuel system operably connected to the engine, said signal controlling an amount of fuel delivered to the engine and adjusting the engine to operate at the second engine speed.

3. The method as set forth in claim 1, wherein selecting the one of the plurality of torque maps includes adjusting the one of the plurality of torque maps.

4. The method as set forth in claim 3, wherein selecting the one of the plurality of torque maps further includes enabling and disabling the one of the plurality of torque maps.

5. The method as set forth in claim 4, wherein adjusting the plurality of the torque maps and enabling and disabling the one of the plurality of torque maps further includes selectively controlling one of the plurality of torque maps.

6. The method as set forth in claim 5, including:

manually adjusting a throttle input; and selectively setting the second engine speed to a predetermined percentage of the torque.

7. The method as set forth in claim 5, wherein the torque maps may include, but are not limited to, a smoke map, a torque limit map, a first programmable torque map, and a second programmable torque map.

8. The method as set forth in claim 1, wherein determining the droop speed related to the first engine speed includes selecting a droop percentage from a predetermined range of droop percentages.

9. The method as set forth in claim 8, wherein the range of droop percentage is from approximately 2.5% to approximately 8%.

10. The method as set forth in claim 8, wherein determining the droop speed related to the first engine speed includes determining a shrink factor.

11. The method as set forth in claim 10, wherein determining the shrink factor further includes increasing the droop speed according to the droop percentage in response to an increase in the first engine speed.

12. The method as set forth in claim 11, wherein determining the shrink factor further includes decreasing the droop speed as the first engine speed approaches a low idle speed such that the second engine speed is equal to an isochronous mode at the low idle speed.

13. An engine control system to control the torque output from an internal combustion engine, comprising:

a torque receiving device operably connected to the engine to receive at least a portion of the torque output from the engine;

a sensor operable to sense an engine parameter, said engine parameter including, but is not limited to at least one of the torque and a first engine speed;

an electronic device operably connected to the sensor to receive the sensed engine parameters from the sensor, said electronic device being operable to determine an second engine speed based on the sensed engine parameter, a droop speed, and a selected one of a plurality of torque maps requiring a minimum amount of fuel related to the first engine speed, said electronic device being operable to generate a signal indicative of the second engine speed; and a fuel system operably connected to the electronic device and the engine, said fuel system being operable to receive the signal from the electric device and control the amount of fuel delivered to the engine.

14. The engine control system as set forth in claim 13, wherein the electronic device is operable to adjust the first engine speed to the second engine speed.

15. The engine control system as set forth in claim 14, wherein at least the one of the plurality of torque maps may be adjusted.

16. The engine control system as set forth in claim 15, wherein at least one of the plurality of torque maps may be enabled and disabled.

17. The engine control system as set forth in claim 16, wherein at least one of the plurality of torque maps are selectively adjustable and manually controllable such that a throttle input may be manually adjusted to selectively set the engine speed to a predetermined percentage of the total torque output.

18. The engine control system as set forth in claim 17, wherein the torque maps may include, but are not limited to, a smoke map, a torque limit map, a first programmable torque map, and a second programmable torque map.

19. The engine control system as set forth in claim 13, wherein the droop speed is determined in part by selecting a droop percentage from a predetermined range of droop percentages.

20. The engine control system as set forth in claim 19, wherein the range of droop percentage is from approximately 2.5% to approximately 8%.

21. The engine control system as set forth in claim 19, wherein the droop speed includes a shrink factor, said shrink factor being adapted to increase the droop speed according to the droop percentage in response to an increase in the first engine speed.

22. The engine control system as set forth in claim 21, wherein the shrink factor decreases the droop speed as the first engine speed approaches a low idle speed such that the second engine speed is equal to an isochronous mode at the low idle speed.

23. The engine control system as set forth in claim 22, wherein the shrink factor causes the slope of a droop line to become vertical as the first engine speed goes from a high idle speed to the low idle speed.

* * * * *

UNITED STATES PATENT AND TRADEMARK OFFICE

CERTIFICATE OF CORRECTION

PATENT NO. : 7,000,590 B2
APPLICATION NO. : 10/881536
DATED : February 21, 2006
INVENTOR(S) : Douglas J. Carlton et al.

It is certified that error appears in the above-identified patent and that said Letters Patent is hereby corrected as shown below:

On the title page item (76),

Please add the city of "Dunlap" for inventor Christopher J. Wichael:

Inventors: Christopher J. Wichael, 1628 W. County Oaks Ct., Dunlap, IL (US) 61525

Please add the name and address of Assignee:

Assignee: Caterpillar Inc., Peoria, IL (US)

On the title page add item (74), Attorney, Agent, or Firm:

Kevin C. Earle and Alan J. Hickman

Signed and Sealed this

Tenth Day of June, 2008

JON W. DUDAS
*Director of the United States Patent and Trademark Office*